US006431539B2

(12) United States Patent
Laroche

(10) Patent No.: US 6,431,539 B2
(45) Date of Patent: Aug. 13, 2002

(54) APPARATUS AND METHOD FOR UNSTACKING SHEETS STACKED IN A FEEDER

(75) Inventor: Francis Laroche, Puymoyen (FR)

(73) Assignee: Esatec Etudes Services Automatismes Techniques Z.A. (FR)

( * ) Notice: Subject to any disclaimer, the term of this patent is extended or adjusted under 35 U.S.C. 154(b) by 0 days.

(21) Appl. No.: 09/800,385

(22) Filed: Mar. 6, 2001

Related U.S. Application Data

(63) Continuation of application No. PCT/FR00/01411, filed on May 24, 2000.

(30) Foreign Application Priority Data

Jul. 13, 1999 (FR) ..... 99/09115

(51) Int. Cl.[7] ..... B65H 3/02
(52) U.S. Cl. ..... 271/106; 271/95
(58) Field of Search ..... 271/91, 92, 93, 271/95, 106; 400/627; 414/797

(56) References Cited

U.S. PATENT DOCUMENTS 3,937,457 A * 2/1976 Schwebel ..... 271/92
RE36,329 E * 10/1999 Laroche ..... 493/96 X

FOREIGN PATENT DOCUMENTS

| | | | | |
|---|---|---|---|---|
| DE | 195 22 741 A | | 1/1997 | |
| EP | 0 381 382 A | | 8/1990 | |
| GB | 763 916 A | | 12/1956 | |
| GB | 1 161 054 A | | 8/1969 | |
| GB | 2 185 652 A | | 7/1987 | |
| JP | 3-238244 | * | 3/1991 | ..... B65H/3/08 |
| JP | 5-246565 | * | 5/1993 | ..... B65H/3/08 |

* cited by examiner

*Primary Examiner*—David H. Bollinger
*Assistant Examiner*—Kenneth W Bower
(74) *Attorney, Agent, or Firm*—Schnader Harrison Segal & Lewis LLP

(57) ABSTRACT

The invention concerns a method for unstacking sheets stacked in a feeder, comprising a step which consists in bringing a vacuum cup close to the surface of the sheet at the top of the stack; a step which consists in contacting the vacuum cup with the surface of said top sheet and a step in bringing the vacuum cup away after seizing the top sheet. The invention is characterized in that the vacuum cup is applied in an off-center zone of the top sheet, and said vacuum cup is inclined, when it starts to move away, so as to cause the top sheet to be deformed thereby producing a separation prior to complete separation of the top sheet.

15 Claims, 9 Drawing Sheets

TURBOTEC "C"

Kinematics

Laying down process

Seizure

V1=constant

V2=0 end of seizure

V1=constant

V2=0

V1=x1^2
V2>V1

Laying down process

V1=V2= constant

End of laying down process

V1=V2= constant

Release process

V1= constant

V2=0

APPARATUS AND METHOD FOR UNSTACKING SHEETS STACKED IN A FEEDER

RELATED APPLICATION

This is a continuation of International Application No. PCT/FR00/01411, with an international filing date of May 24, 2000, which is based on French Patent Application No. 99/09115, filed Jul. 13, 1999.

FIELD OF THE INVENTION

This invention relates to the field of unstacking sheets stacked in a feeder, in particular, semi-rigid PVC sheets stacked in a feeder.

BACKGROUND

In the state of the art, stackers are known to include a drive mechanism with a vacuum cup which is alternatively brought close, put into contact then moved away from the stack of sheets. The vacuum cup is laid against the top sheet of the stack and then carries away the top sheet to bring it away from the stack before laying it down on another work area, for example, on a cut transported by a vacuum conveyor. U.S. Pat. No. 5,254,071 describes an unstacker which operates according to this principle.

Such a device is not totally satisfactory. Vacuum cup kinematics produces an initial separation of a central area of the top sheet, which slightly bulges before complete unstacking. This bulging arises from the sticking phenomenon of superimposed sheets, notably resulting from electrostatic forces formed between two sheets of insulating materials such as PVC. The unstacking is not properly performed and it may cause malfunctions of the unstacker.

Accordingly, it would be advantageous to improve the unstacking of semi-rigid sheets, in particular, PVC sheets stacked in a feeder. In particular, it would be advantageous to avoid the drawback of the sticking of two consecutive sheets causing two sheets to be picked up simultaneously, or causing inaccurate positioning of the sheet consecutive to the top sheet which has just been picked up.

SUMMARY OF THE INVENTION

This invention relates to a method of unstacking sheets stacked in a feeder including a) bringing a vacuum cup close to the surface of a top sheet of the stack, b) contacting the vacuum cup with the surface of the stop sheet in an off-center area of the top sheet, and c) bringing the vacuum cup away from the stack after seizing the top sheet, such that the vacuum cup is inclined, at the beginning of step c) to cause the top sheet to be deformed, thereby producing a side separation prior to complete separation of the top sheet.

This invention also relates to an apparatus for unstacking stacked sheets including a rotatable turn table driving at least a support of a vacuum cup and including a vacuum cup support formed by a jointed arm that is movable with respect to a swivel axis extending substantially perpendicularly to a peripheral area of the rotatable turn table, wherein the jointed arm is guided by a guide connecting rod, one end of which is translationally guided by a linear bearing supported by an axis of rotation of the rotatable turn table, and the other end of which is connected to the jointed arm through a swivel.

BRIEF DESCRIPTION OF THE DRAWINGS

The invention will be better understood upon reading the following description, with reference to the appended drawings, wherein.

DETAILED DESCRIPTION

The invention relates, in its most general sense, to a method for unstacking sheets stacked in a feeder, including a step of bringing a vacuum cup close to the surface of the top sheet of the stack, a step for contacting the vacuum cup with the surface of the top sheet and a step of bringing the vacuum cup away after seizing the top sheet, wherein the vacuum cup is applied in an off-center area of the top sheet, and wherein the vacuum cup is inclined, at the beginning of the step when it moves away, thereby causing the top sheet to be deformed and producing a separation prior to complete separation of the top sheet.

Advantageously, the vacuum cup is inclined by tilting it with respect to the side area of the vacuum cup, the closest to the center of the top sheet.

According to a preferred embodiment, the vacuum cup is brought close to the top sheet along a first curved path substantially tangent to the normal to the top sheet, and the vacuum cup is moved away, after contacting the top sheet, along a curve substantially symmetrical to the first curve, with respect to a plane perpendicular to the surface of the top sheet.

According to a particular alternative embodiment, the vacuum cup is inclined during the step when it moves away, along an initial path substantially corresponding to the end of the first curve.

The invention also relates to a piece of equipment for unstacking stacked sheets, including a rotatable turn table driving at least a support of a vacuum cup, characterized in that it includes a vacuum cup support formed by a jointed arm, mobile with respect to a swivel axis extending substantially perpendicularly to a peripheral area of the rotatable turn table, wherein said jointed arm is guided by a guide connecting rod, one of the ends of which is translationally guided by a guide bearing supported by the axis of rotation of the rotatable turn table, and the other end of which is connected to the jointed arm through a swivel.

Advantageously, the vacuum cup support is formed by two segments jointed through a swivel.

Preferably, the rear segment of the vacuum cup support is driven by a motor independent of the drive motor of the main turn table supporting the jointed arms.

According to an advantageous alternative embodiment, the driving motor for the jointed arm is controlled by a computer receiving a signal from a sensor detecting the passage of the edge of the sheet supported by the vacuum cup.

Preferably, the connecting rod is connected to the external segment of the jointed arm by a laterally off-set swivel.

Figure 1:
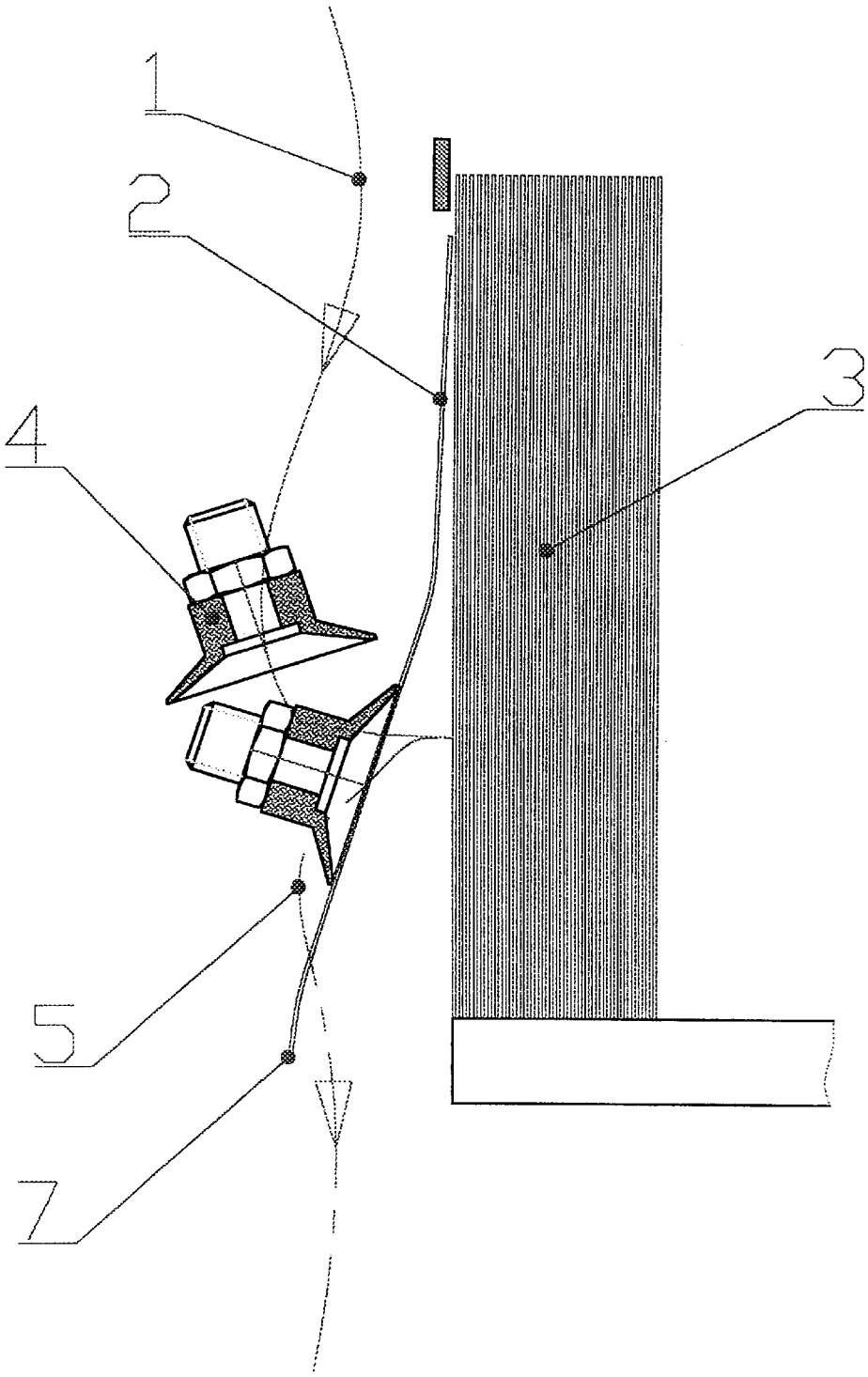
FIG. 1 shows a schematic view of the kinematics of the vacuum cup of a piece of equipment according to the invention.

Turning now to the drawings, FIG. 1 shows the path of the vacuum cup during the steps when the vacuum cup is brought close and moved away. The approach of the vacuum cup is performed along a curved path (1) which meets the top sheet (2), tangentially with a plane normal to the surface of the top sheet (2). Contact between the vacuum cup (4) and the top sheet (2) is achieved in an offset area with respect to the center (3) of the top sheet (2). The illustrated path corresponds to the displacement of the center of the suction area of the vacuum cup.

Figure 2:
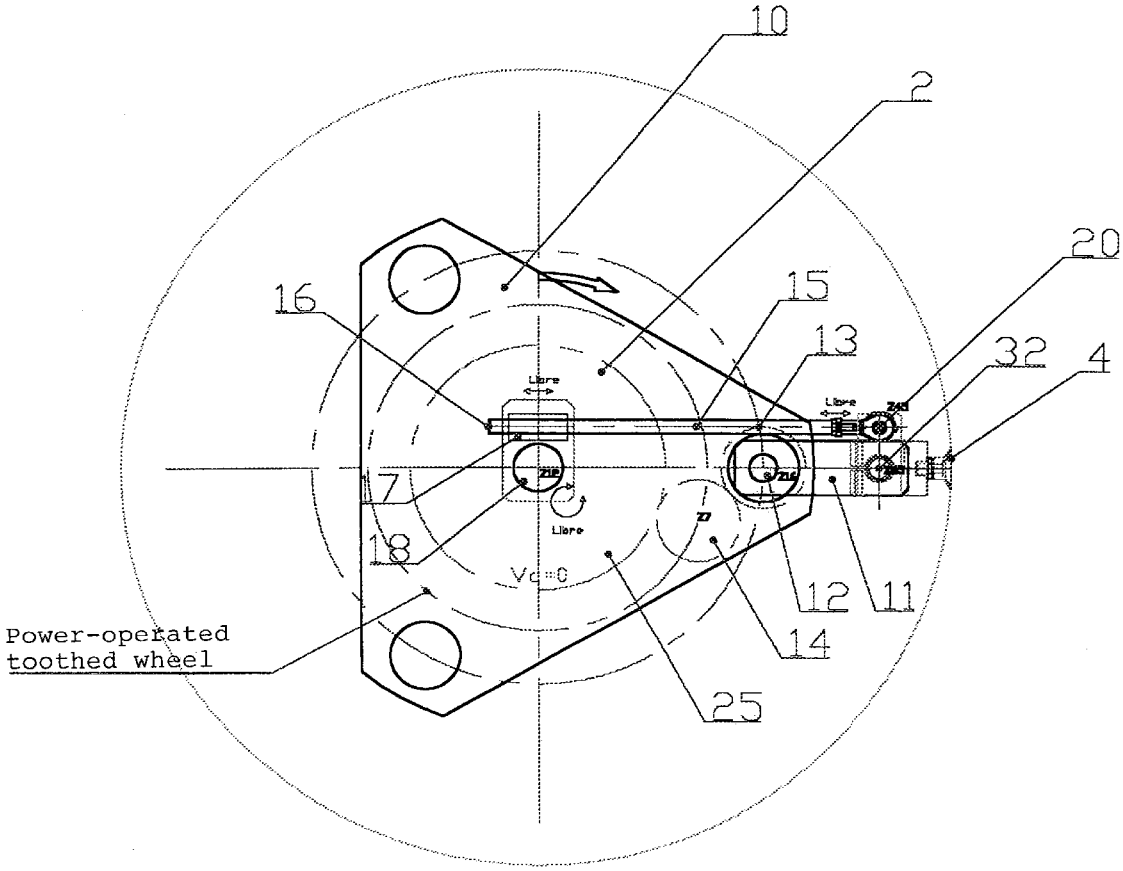
FIG. 2 shows a schematic view of a piece of equipment according to the invention.

The path is determined by combining a rotary movement of the main turn table (10) as shown in FIG. 2 and the oscillating tilting movement of the support of the vacuum cup with respect to swivel (12). When the vacuum cup is in contact with the sheet, the vacuum cup is inclined so that it "lands" substantially tangentially on the surface of the top sheet, so that it is then tilted to lift the smallest side of the sheet and to ensure separation of one of its side edges (7), before causing the top sheet to move away with respect to the surface of the adjacent sheet. The moving away is then performed along a second curved path (5) substantially symmetrical with respect to a plane perpendicular to the surface of the sheet (2). The vacuum cup is inclined in such a way that the contact plane forms a dihedron with the surface of the sheet and the edge (7) positioned on the side of the contact area between the vacuum cup (4) and the sheet (2) is separated the first. This lateral separation causes air to be introduced gradually between the top sheet (2) and the next sheet. In this way, the picking up of two sheets which remain stuck or the untimely displacement of the lower sheet is prevented.

FIG. 2 shows a schematic view of a piece of equipment according to the invention. It includes a rotatable turn table (10) turning at substantially constant speed. This main turn table (10) supports in the described example three vacuum cup supports, including one illustrated in FIG. 2. Each vacuum cup support is formed by a jointed arm (11) securely fixed to the rotatable turn table (10) via a swivel (12). This swivel (12) extends perpendicularly to the turn table (10) and is fixed close to the edge of the turn table. The jointed arm has two segments (30, 31) connected through a swivel (32) parallel to swivel (12). The external segment (31) of the jointed arm (11) supports the vacuum cup (4), at the end opposite to swivel (12). A planet gear (13) drives the jointed arm (11) into rotation via a toothed crown (14). The gear (13) is driven by a power-operated crown (25) actuated by an independent motor, controlled by a computer. The angular position of the power-operated crown (25) is monitored by a computer which further receives information from optoelectronic sensors detecting possible drifts in the position of the sheet with respect to the nominal position.

The tilting of the jointed arm (11) is guided by a connecting rod (15), one of the ends (16) of which is translationally guided by a linear bearing (17) securely fixed to axis (18), coaxial with the axis of the turn table (10). The other end (19) of connecting rod (15) is connected to the external segment (31) of the jointed arm (11) via a laterally offset swivel (20) with respect to the external segment (31) of the vacuum cup carrier arm.

Figure 3:
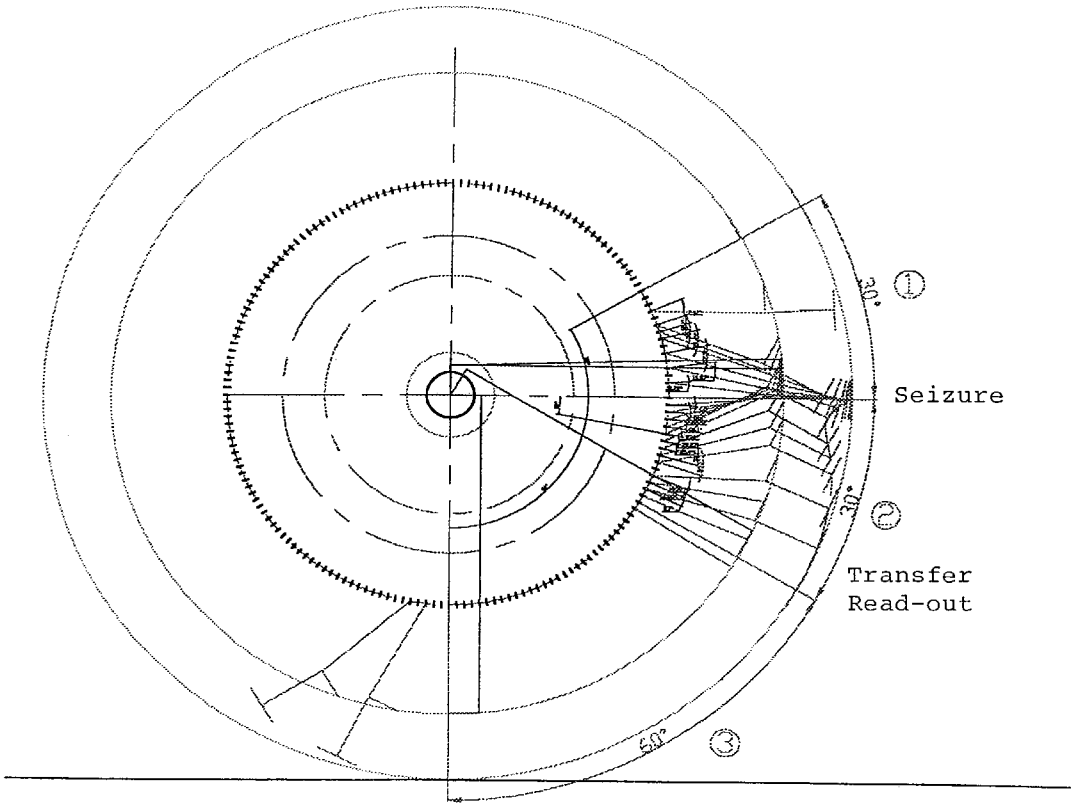
FIG. 3 shows a schematic view of the movement of the vacuum cup support.

FIG. 3 schematically illustrates the kinematics of the device according to the invention. The movement is broken down into three phases:

1—Seizing the cutout in the magazine by the vacuum cups:

The seizure height for the vacuum cups is located at about 50 mm from the lower edge of the PVC sheet with respect to the direction of rotation. This favors collation accuracy upon placing the PVC sheet on the cardboard cut, whereby the PVC is maintained ahead of the feeding direction.

Upon seizure, the path of the vacuum cup plays a determining role as regards speed and accuracy in the unstacking of cutouts in the magazine.

Accuracy: The vacuum cup must come and seize the cutout through a contact point without any slipping. At this particular point of the seizure, the vacuum cup is normal to the cutout.

Velocity: In order to rapidly unstack a packet of sheets in the magazine, introduction of air must be facilitated between the sheet which one wants to unstack and the rest of the packet, this counters the sticking phenomenon occurring through a "freeze effect". The vacuum cup must then be inclined downwards, in the direction of the path, contrary to the path of a hypocycloid after its turning point.

2—Transfer Phase:

This phase corresponds to transfer of the cutout, from its seizure to its laying down, through the shortest path. By directing the vacuum cup towards a circular uniform path as earlier as possible, the cutout may be read by a cell, for an electronic straightening of the product before its laying down.

3—Laying Phase:

The velocity describes a circular uniform path. Upon laying the cutout down on the cardboard slip case, the velocity of both products is then substantially identical.

FIGS. 4–9 illustrate the device at different stages of a cycle. Only one vacuum cup support is illustrated for ease of understanding.

Figure 4:
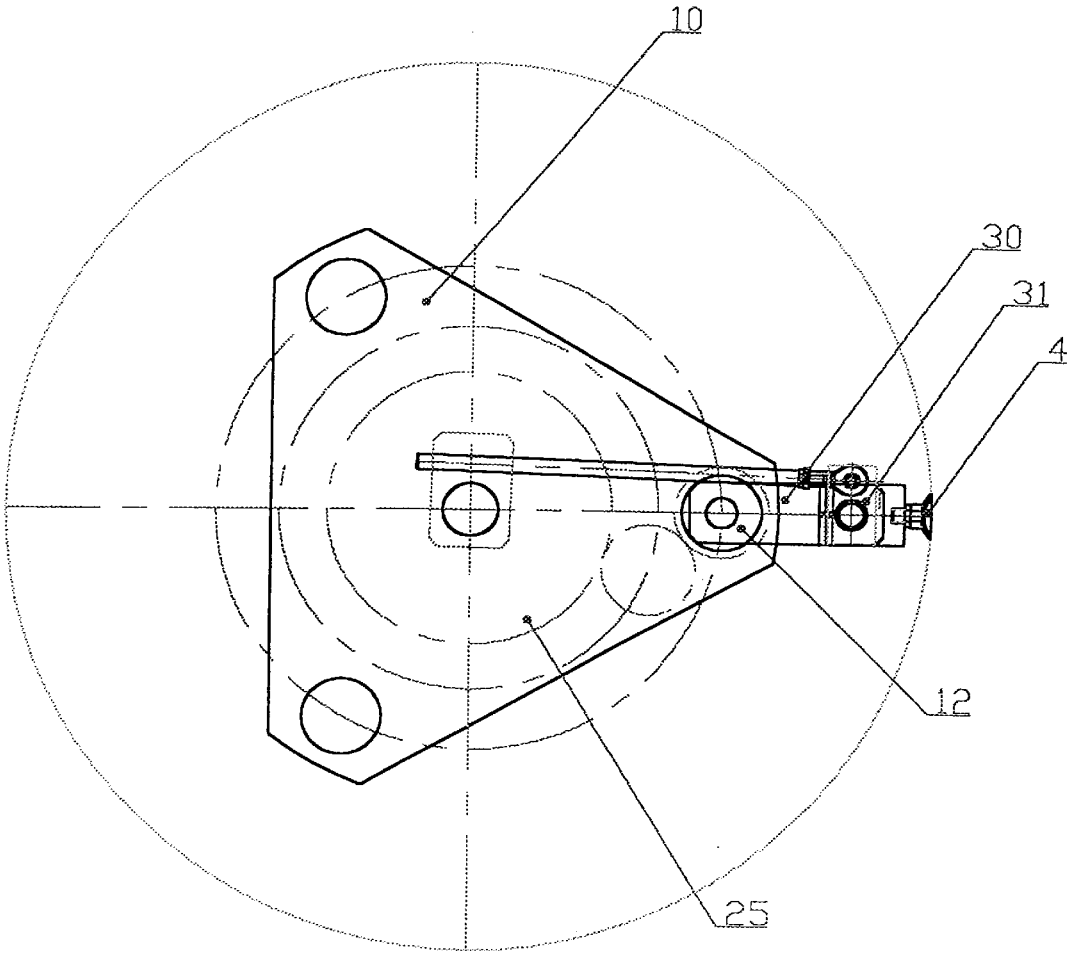
FIGS. 4–9 show the device at different stages of a cycle.

At the moment when the sheet is seized by the feeder, the device takes up the position illustrated in FIG. 4. The pointed arm (11) is radially oriented, wherein both segments (30) and (31) are aligned. The vacuum cup (4) is in line with the jointed arm (11), in its maximum extension. The supporting surface of the vacuum cup is in a plane substantially normal to the jointed arm (11) and, therefore, parallel to the sheet to be picked up. The turn table (10) is driven at substantially constant velocity $V_p$ during the whole cycle.

The power-operated crown (25) is stopped.

Figure 5:
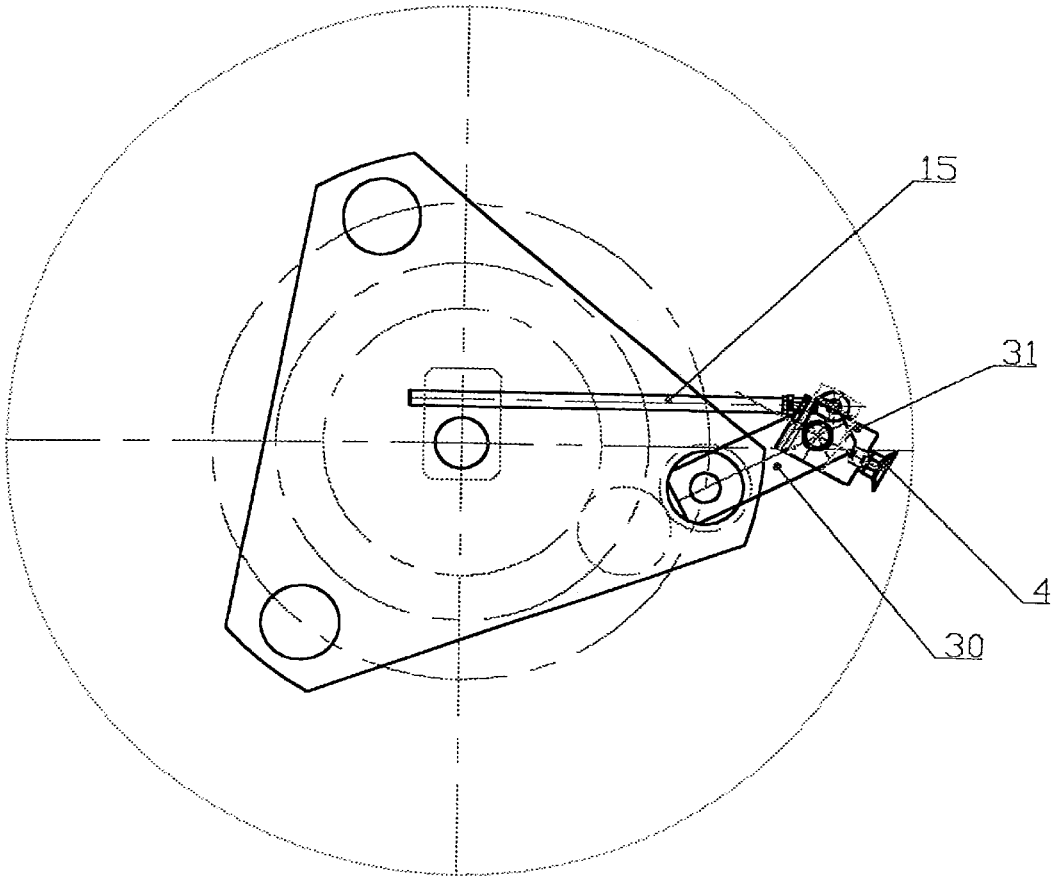
Figure 6:
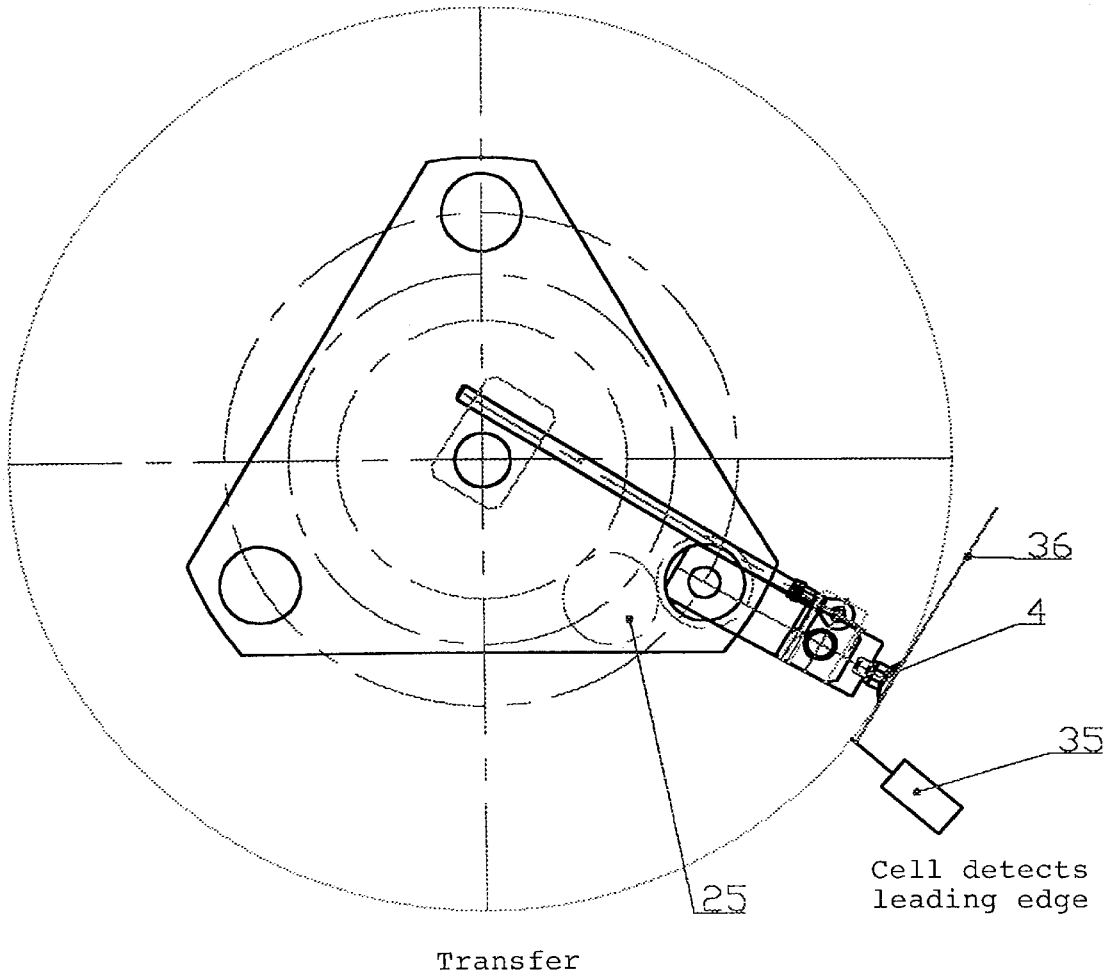
Figure 7:
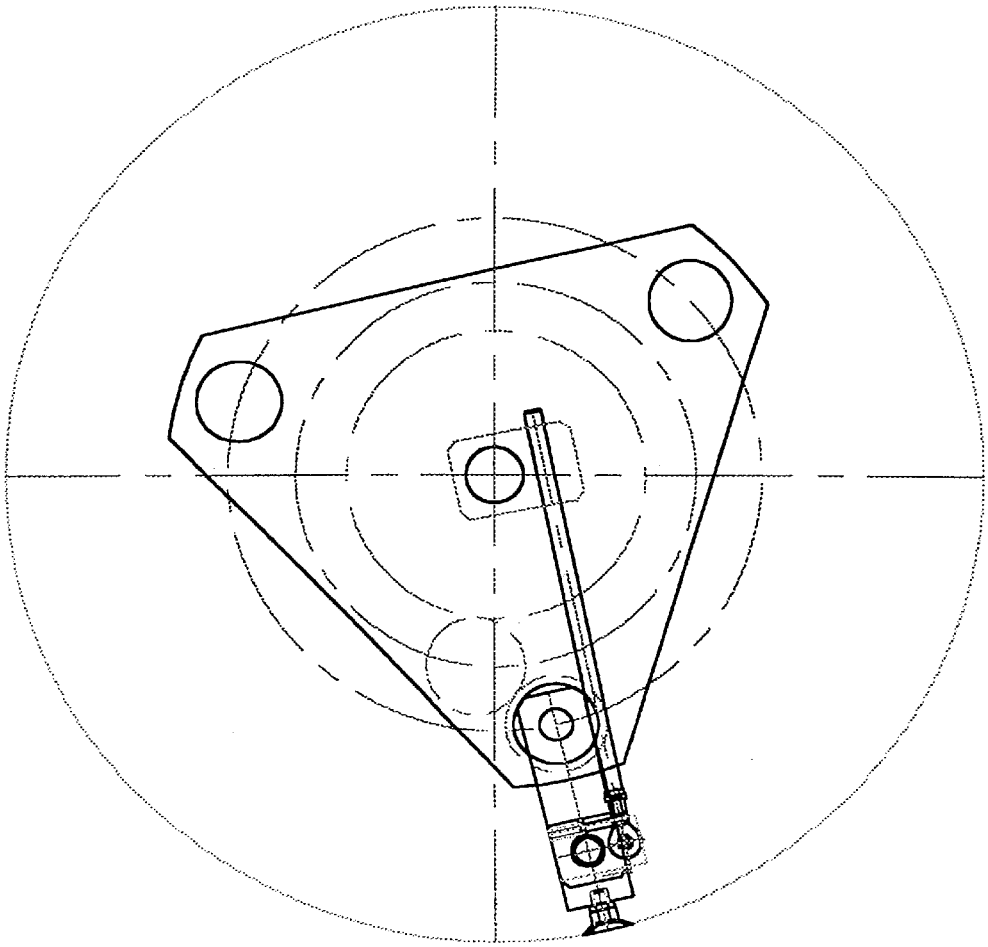

Rotation of the turn table (10) causes tilting of the vacuum cup carrier as illustrated in FIG. 5. The rear segment (30) is tilted in the opposite direction relatively to the direction of rotation of turn table (10). The external segment (11) tilts in the same direction as the turn table (10) under the guiding effect by the connecting rod (15). This movement of the jointed arm (11) causes the vacuum cup to be displaced towards the center of the turn table, and the suction surface of the vacuum cup is tilted, causing the sheet to form the dihedron as described earlier.

When the turn table has turned by a few degrees, power-operated crown (25) is driven at a greater rotation velocity $V_e$ than velocity $V_p$ of the main turn table. The jointed arm (11) then resumes a rectilinear configuration and the vacuum cup (4) is taken back to its external position.

A sensor (35) detects the passage of the edge of the sheet (36) and transmits time information to the computer which controls the rotational velocity of the power-operated crown (25). If there is a shift with respect to a set point, the rotational velocity is increased or reduced in order to provide positioning of the sheet when it is laid on the flong driven by a belt conveyor.

Figure 8:
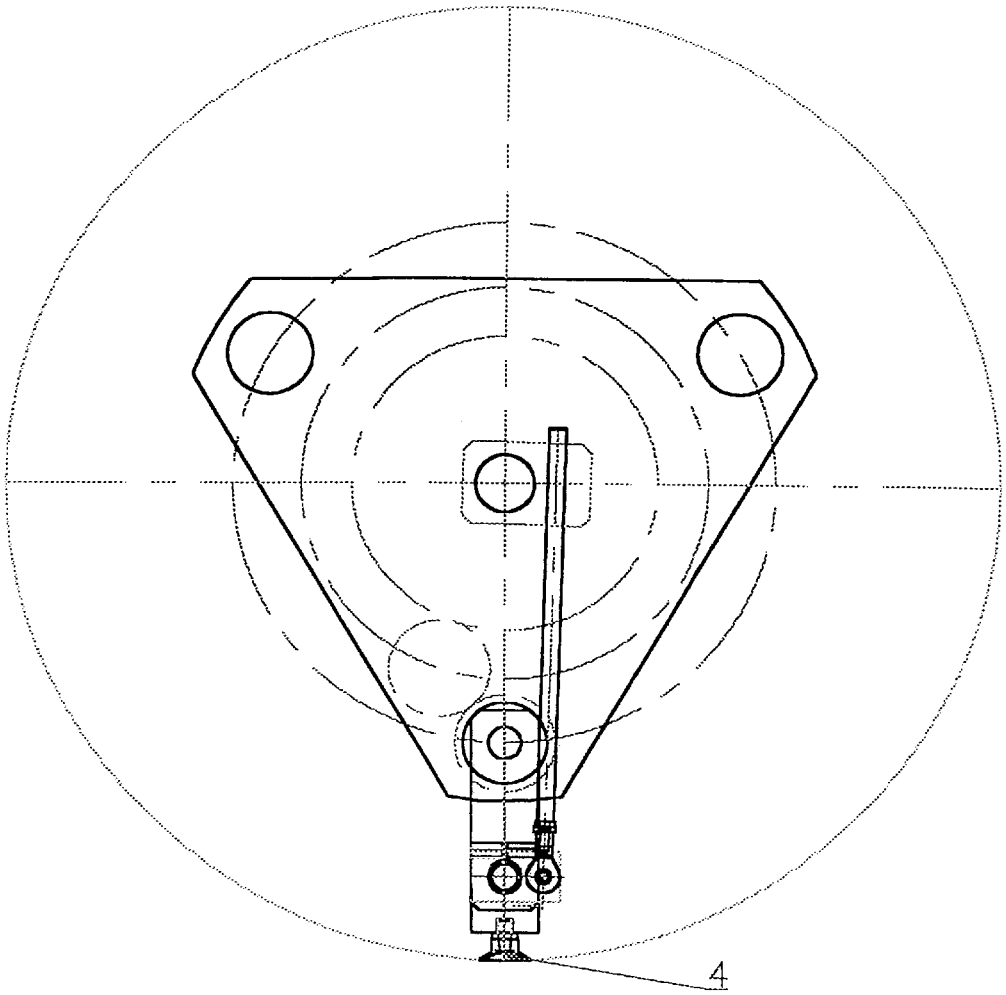
Figure 9:
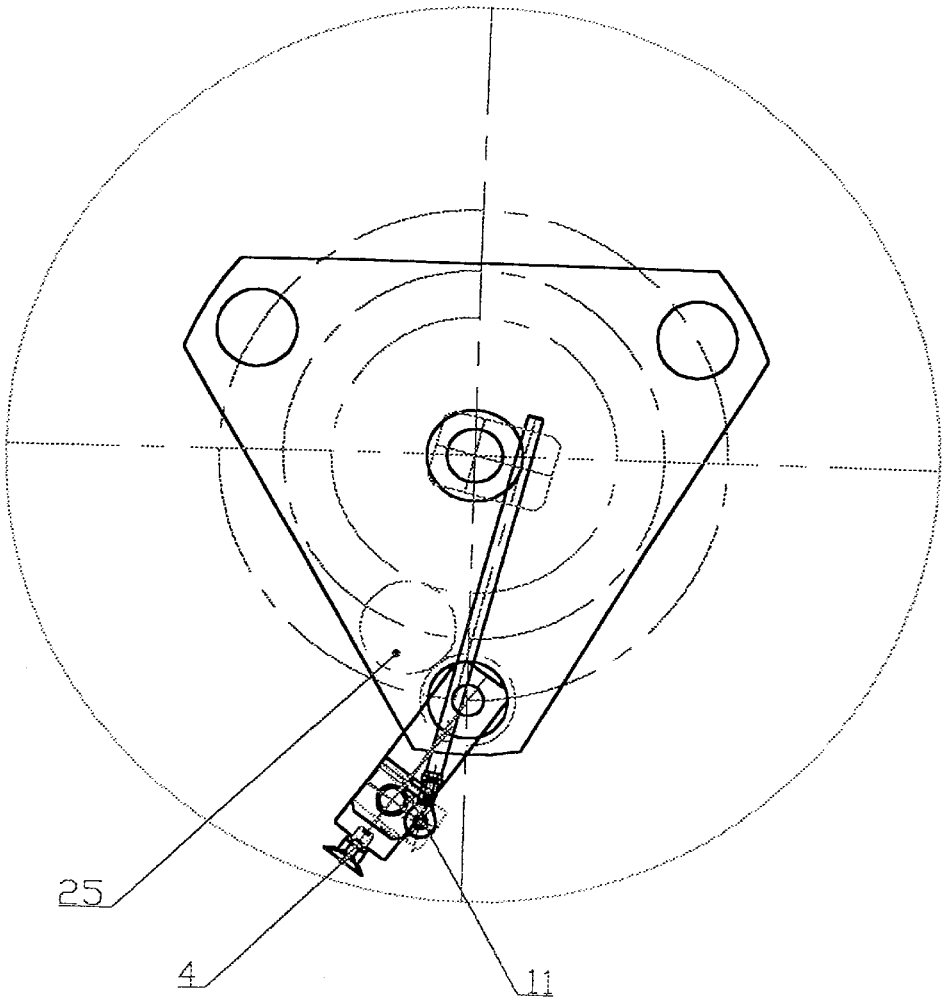

Upon laying it down, the turn table (10) and the toothed crown (14) are driven at substantially identical velocities, synchronized with the traveling velocity of the flong on which the sheet (36) is laid down, as illustrated in FIG. 8.

After it is laid down, the power-operated crown (25) is again stopped, causing the jointed arm (11) to fold back and the vacuum cup to be withdrawn towards the center of the turn table.

During the end of the cycle, the power-operated crown (25) is again driven in order to provide the displacement of the vacuum cup in the outward direction, according to a movement illustrated in FIG. 1.

What is claimed is:

1. A method of unstacking sheets stacked in a feeder comprising:

(a) moving one or more vacuum cups close to a surface of a top sheet of a stack along a path with a open end of said one or more vacuum cups being inclined in a direction of motion of said one or more vacuum cups;

(b) seizing said surface of said top sheet of said stack with said open end of said one or more vacuum cups; and (c) tilting said open end of said one or more vacuum cups in said direction of motion of said one or more vacuum cups to cause said top sheet to be deformed while said one or more vacuum cups continues to move on said path thereby completing a separation of said top sheet from said stack.

2. The method of unstacking stacked sheets according to claim 1, wherein the vacuum cup is inclined by tilting with respect to a side area of the vacuum cup closest to a center portion of the top sheet.

3. The method of unstacking stacked sheets according to claim 1, wherein the vacuum cup is brought close to the top sheet along a first curved path substantially tangent with a plane normal to the top sheet, and wherein the vacuum cup is moved away, after contacting the top sheet, along a curve substantially symmetrical to the first curve, with respect to a plane perpendicular to the surface of the top sheet.

4. The method of unstacking stacked sheets according to claim 2, wherein the vacuum cup is brought close to the top sheet along a first curved path substantially tangent with a plane normal to the top sheet, and wherein the vacuum cup is moved away, after contacting the top sheet, along a curve substantially symmetrical to the first curve, with respect to a plane perpendicular to the surface of the top sheet.

5. The method for unstacking stacked sheets according to claim 3, wherein the vacuum cup is inclined, during step c), along an initial path substantially corresponding to the end of the first curve.

6. The method for unstacking stacked sheets according to claim 4, wherein the vacuum cup is inclined, during step c), along an initial path substantially corresponding to the end of the first curve.

7. An apparatus for unstacking stacked sheets comprising a rotatable turn table driving at least a support of a vacuum cup and including a vacuum cup support formed by a jointed arm that is movable with respect to a swivel axis extending substantially perpendicularly to a peripheral area of the rotatable turn table, wherein said jointed arm is guided by a guide connecting rod, one end of which is translationally guided by a linear bearing supported by an axis of rotation of the rotatable turn table, and another end of which is connected to the jointed arm through a swivel.

8. The apparatus according to claim 7, wherein the support of vacuum cup is formed by two segments jointed through a swivel.

9. The apparatus according to claim 8, wherein a rear segment of the support of the vacuum cup is driven by a motor independent of a drive motor of the main turn table supporting the jointed arms.

10. The apparatus according to claim 9, wherein the drive motor of the jointed arm is controlled by a computer receiving a signal from a sensor detecting the passage of an edge of the sheet supported by the vacuum cup.

11. The apparatus according to claim 7, wherein the connecting rod is connected to an external segment of the jointed arm through a laterally offset swivel.

12. The apparatus according to claim 8, wherein the connecting rod is connected to an external segment of the jointed arm through a laterally offset swivel.

13. The apparatus according to claim 9, wherein the connecting rod is connected to an external segment of the jointed arm through a laterally offset swivel.

14. The apparatus according to claim 10, wherein the connecting rod is connected to an external segment of the jointed arm through a laterally offset swivel.

15. A method of unstacking sheets stacked in a feeder comprising:

(a) moving one or more vacuum cups close to a surface of a top sheet of a stack along a first curved path that is substantially parallel with said surface of said top sheet with a open end of said one or more vacuum cups inclined in a direction of motion of said one or more vacuum cups;

(b) seizing said surface of said top sheet of said stack with said open end of said one or more vacuum cups; and (c) tilting said open end of said one or more vacuum cups in said direction of motion of said one or more vacuum cups traveling on a second path tat continues in a same direction and is symmetrical to said first curved path to cause said top sheet to be deformed while said one or more vacuum cups continues to move on said second path thereby completing a separation of said top sheet from said stack.

* * * * *